US006286285B1

(12) United States Patent
Martell

(10) Patent No.: US 6,286,285 B1
(45) Date of Patent: Sep. 11, 2001

(54) WALL BRACKET FOR HANGING CEILING PANEL

(76) Inventor: Conrad P. Martell, 1631 Harbison Canyon Rd. #50, El Cajon, CA (US) 92019-1311

( * ) Notice: Subject to any disclaimer, the term of this patent is extended or adjusted under 35 U.S.C. 154(b) by 0 days.

(21) Appl. No.: 09/556,996

(22) Filed: Apr. 24, 2000

(51) Int. Cl.[7] ..... E04B 1/38; E04C 5/00

(52) U.S. Cl. ..... 52/712; 52/712; 52/747.1; 52/509; 52/512; 52/731.7

(58) Field of Search ..... 52/712, 489.1, 52/715, 714, 483.1, 506.07, 282.3, 283, 211, 204.53, 716.1, 509, 512, 730.6, 731.7, 733.3, 506.06

(56) References Cited

U.S. PATENT DOCUMENTS 4,835,916 * 6/1989 Steadman ..... 52/28

5,226,274 * 7/1993 Sommerstein ..... 52/512

* cited by examiner

*Primary Examiner*—Carl D. Friedman
*Assistant Examiner*—Chi Nguyen
(74) *Attorney, Agent, or Firm*—Calif Tervo

(57) ABSTRACT

A wall bracket (10) for aiding in attaching a ceiling panel (90) to ceiling structure (80) next to a wall (70); ceiling panel (90) having a thickness and peripheral edges (98). Bracket (10) generally comprises a vertical, wall-abutting member (20) for attachment to wall (70) and a shelf (50) for receiving and supporting edge (98) of ceiling panel (90). Vertical member (20) includes a lower portion (30) and an upper portion (40). Lower portion (30) is temporarily attached to the wall and includes an aperture (32) for aiding in removal. Upper portion (40) spaces shelf (50) from ceiling structure (80). Shelf (50) has an outer end (56) having an outwardly downwardly slanted portion (57) for facilitating entry of edge (98) of panel (90) onto shelf (50).

19 Claims, 1 Drawing Sheet

WALL BRACKET FOR HANGING CEILING PANEL

FIELD OF THE INVENTION

This invention relates to a bracket to aid in attachment of large ceiling panels, such as drywall or gypsum board panels, to a ceiling adjacent a wall.

BACKGROUND OF THE INVENTION

Large ceiling panels are typically four by eight foot sections of drywall having a thickness of one-half inch. Such panels are large, relatively heavy, and awkward to handle. Even larger panels of twelve feet in length are sometimes used. It is difficult for a hanger, i.e. the person attaching the panel, to simultaneously hold the panel to the ceiling and fasten it to the ceiling, such as by nailing.

Conventionally, jacks or supports from the floor have been used to temporarily support a panel on the ceiling while the panel is fastened. However, typically, such support systems require two hangers.

It is desirable to have a device capable of aiding a hanger such that a single hanger can more easily attach ceiling panels.

SUMMARY OF THE INVENTION

This invention is a wall bracket for aiding in attaching a ceiling panel to ceiling structure next to a wall, the ceiling panel having a thickness and peripheral edges. The bracket generally comprises a vertical, wall-abutting member for temporary attachment to the wall and a shelf for receiving and supporting an edge of the ceiling panel.

The vertical member includes a lower portion and an upper portion. Lower portion is for temporary attachment to the wall including an aperture having an edge upon which an extraction tool may exert a downward force. The aperture is for exposing the lower edge of a horizontal member of the wall such that an extraction tool may bear against the lower edge of the horizontal member and the edge of the aperture for aiding in extraction of the bracket after attachment of the panel. The upper portion includes a spacer portion for contacting the ceiling structure for spacing the shelf a panel thickness from the ceiling structure.

The shelf has an outer end having an outwardly downwardly slanted portion for facilitating entry of the edge of the panel onto the shelf.

The features and advantages of the invention will be readily understood when the detailed description thereof is read in conjunction with the accompanying drawings wherein like reference numerals refer to like parts throughout.

DETAILED DESCRIPTION OF THE INVENTION

Figures 1, 2, 3:
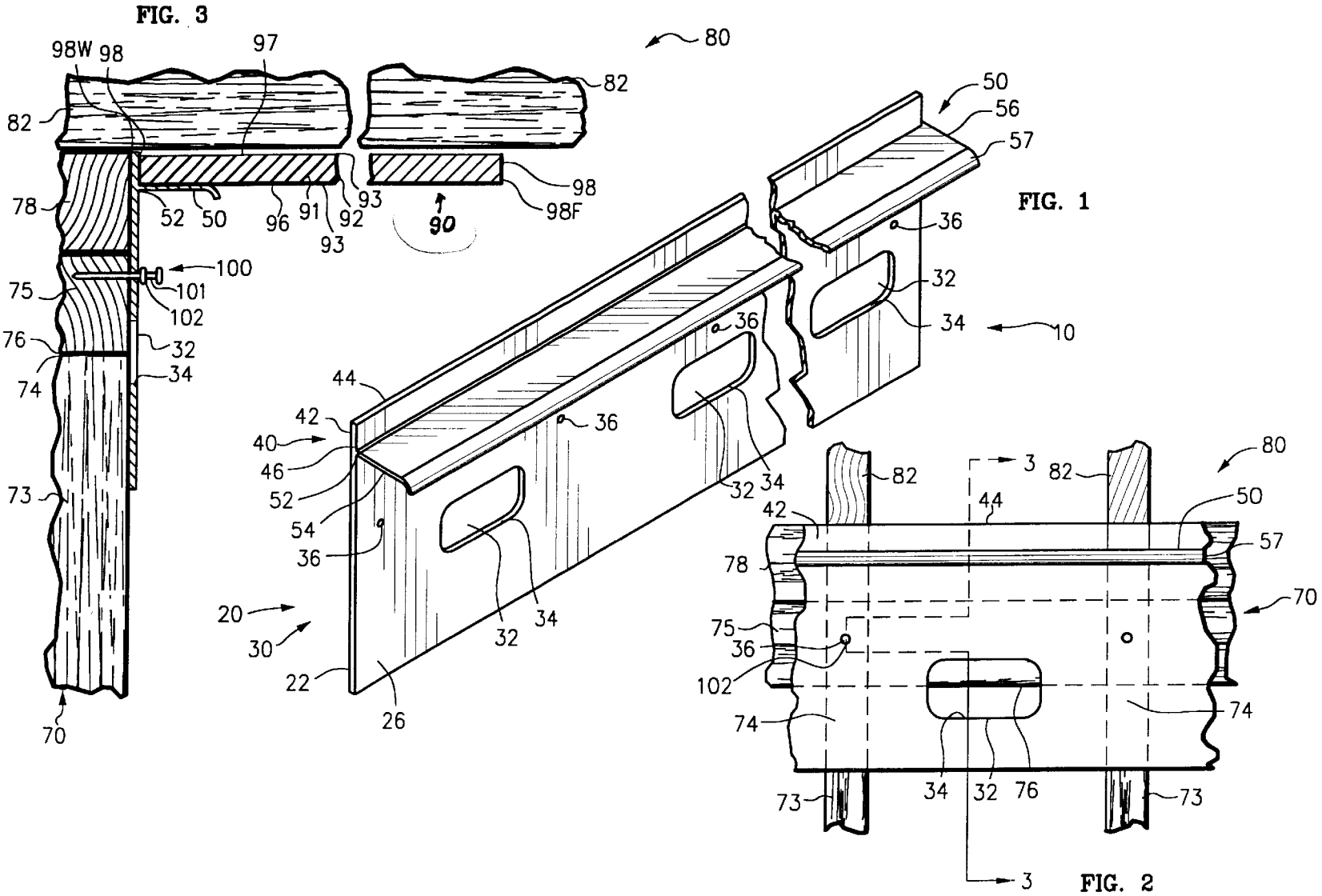
FIG. 1 is a partially cut away, perspective view of a preferred embodiment of the bracket of the invention.
FIG. 2 is a partially cut away, front view of the bracket of FIG. 1 as attached to a wall adjacent a ceiling.
FIG. 3 is a partial sectional view taken on line 3—3 of FIG. 2 and further including a ceiling panel.

FIG. 1 is a partially cut away, perspective view of a preferred embodiment of the wall bracket 10 of the invention. FIG. 2 is a partially cut away, front view of bracket 10 of FIG. 1 as attached to a wall 70 adjacent a ceiling 80. FIG. 3 is a partial sectional view taken on line 3—3 of FIG. 2 and further including a ceiling panel 90.

Ceiling panel 90, such as gypsum board or drywall 91, is planar and includes a central core 92 of mineral material, an outer surface of paper 93 bonded thereto, including a lower surface 96, an upper surface 97 and a peripheral edge 98. A typical drywall ceiling panel 91 has a thickness of one-half inch, a length of eight feet and a width of four feet.

Typical wall 70 includes structure, such as vertical wall studs 73, and horizontal members, including a plate 75 having a lower edge 76, and a top plate 78. These structural members are typically two by fours. Studs 73 each have an upper end 74 supporting plate 75. Plate 75 supports top plate 78. Top plate 78 supports ceiling joists 82. Studs 73 and joists 82 typically have standard spacing, such as on sixteen inch centers.

Bracket 10 aids in attaching ceiling panel 90 on ceiling 80 next to wall 70. Bracket 10 generally comprises a vertical, wall-abutting member 20 for temporary attachment to wall 70 and a shelf 50 for receiving and supporting an edge 98, such as wall edge 98W, of drywall 91 such that drywall 91 upper surface 97 abuts joists 82. Preferably, bracket 10 is elongate, such as five feet long, for supporting edge 98W of panel 90 over a sizable portion of its length. Only a single bracket 10 need be used if bracket 10 is sufficiently long. Alternatively, a plurality of shorter brackets could be used.

Vertical member 20 has a wall facing side 22 and a room facing side 26. Vertical member upper portion 40 includes a spacer portion 42 including a top end 44 and a bottom end 46. Spacer portion 42 is thin in thickness, preferably one-eighth inch or less and has a height for spacing shelf 50 a distance equal to the thickness of drywall 91 below joists 82. Top end 44 is for placing in contact with the bottom of the ceiling structure.

Vertical member 20 includes a lower portion 30 for temporary attachment to wall 70 and an upper portion 40. Lower portion 30 includes a plurality of bores, such as longitudinal bores 36, for receiving fasteners 100, such as nails 101, such as duplex nail 102, for fastening bracket 10 to wall 70. Preferably, also, bores 36 are located a distance from the top end 44 so as to abut a horizonal wall member, such as plate 75. If wall 70 has a horizontal member into which fasteners 100 can be driven, then the longitudinal spacing of bores 36 is not so important.

Shelf 50 has an inner end 52 attached to vertical member 20 at the bottom end 46 of spacer portion 40, a central horizonal portion 54 for supporting drywall 91, and an outer end 56 having an outwardly downwardly slanted portion, such as bevel or lip 57, for facilitating entry of the edge 98W of panel 91 onto shelf 50. A horizontal portion of one and one-quarter inches in length and a total length of one and one-half inches work well.

Lower portion 30 includes a plurality of apertures 32, each having an upward facing wall or edge 34. Apertures 32 are used to aid in extraction of bracket 10 once panel 90 is attached. During attachment of panel 90, spacer portion 42 is often tightly pinched between panel 90 and wall 70. Apertures may be grabbed by hand or with a tool to aid in pulling to extract spacer portion 42 from between panel 90 and wall 70. Preferably also, apertures 32 are spaced from top end 44 for disclosing a lower edge of a horizontal wall member, such as lower edge 76 of plate 75. This spacing would typically center an aperture, having a vertical opening of about one and one-eight inches, three inches down from top 44. Any lever, such as a pry bar, screw driver or hammer, can be used to pry between lower edge 76 of plate 75 and edge 34 of aperture 32 to pry bracket 10 downward and extricate it. Preferably, apertures 32 are spaced to fit between studs 73.

In use, the hanger places wall facing side 22 of bracket 10 against the upper end of wall 70 such that upper end 44 abuts ceiling 80, such as the bottom of joists 82, and temporarily attaches bracket 10, such as with duplex nails 102 in bores 36. The hanger then lifts panel 91 and slides wall edge 98W over lip 57 onto shelf 50 and against spacer portion 42 so that edge 98 abuts spacer portion 42 along its length and parallels wall 70. The hanger then attaches, such as with nails 101, panel 90, such as near field edge 98F, which is opposite wall edge 98W, to joists 82. In this manner, hanger need only hold one half the weight of panel 91 aloft while hammering the first nail. Hanger then applies as many nails as necessary to attach panel 91 to ceiling 80. Hanger removes bracket 10 from wall 70 by extracting nails 102 that are attaching bracket 10 to wall 70 and pulling or prying bracket 10 downward.

I claim:

1. A method of attaching a ceiling panel to ceiling structure next to a wall; the ceiling panel having a thickness and peripheral edges; the method comprising the steps of:

procuring a wall bracket comprising a vertical, wall-abutting member for temporary attachment to the wall including: a lower portion for attachment to the wall; and an upper portion including: a spacer portion including: a top end; and a bottom end; and a shelf for receiving and supporting an edge of the ceiling panel including: an inner end attached to the vertical member at the bottom end of the spacer portion;

attaching the wall bracket to the wall such that the top end of the spacer portion contacts the ceiling structure;

supporting an edge of the panel on the shelf;

fastening the panel to the ceiling; and wherein the wall includes a horizontal member having a lower edge and the lower portion of the vertical member includes an aperture disclosing the lower edge of the horizontal member when the bracket is temporarily attached to the wall and for receiving an extraction tool for aiding in extraction of the bracket, and further including the step of:

extracting the bracket, after the panel is fastened, by inserting an extraction tool in the aperture.

2. A method of attaching a ceiling panel to ceiling structure next to a wall; the ceiling panel having a thickness and peripheral edges; the method comprising the steps of:

procuring a wall bracket comprising a vertical, wall-abutting member for temporary attachment to the wall including: a lower portion for attachment to the wall; and an upper portion including: a spacer portion including: a top end; and a bottom end; and a shelf for receiving and supporting an edge of the ceiling panel including: an inner end attached to the vertical member at the bottom end of the spacer portion;

attaching the wall bracket to the wall such that the top end of the spacer portion contacts the ceiling structure;

supporting an edge of the panel on the shelf;

fastening the panel to the ceiling; and wherein the wall includes a horizontal member having a lower edge, and the lower portion of the vertical member includes an aperture disclosing the lower edge of the horizontal member when the bracket is temporarily attached to the wall and for receiving a prying tool for aiding in extraction of the bracket, and further including the step of:

extracting the bracket, after the panel is fastened, by inserting a prying tool in the aperture and prying between the bracket and the lower edge of the horizontal member.

3. In combination:

a ceiling panel having a thickness and including:

an upper surface;

a lower surface; and a wall edge for disposition near a wall; and a wall bracket for aiding in attaching said ceiling panel to ceiling structure next to the wall; said wall bracket comprising:

a vertical, wall-abutting member including:

a lower portion for temporary attachment to the wall; and an upper portion including:

a spacer portion including:

a top end for contacting the ceiling structure; and a bottom end; said spacer portion having a height between said top end and said bottom end equal to the thickness of said ceiling panel; and a shelf including:

an inner end attached to said wall-abutting member at the bottom end of said spacer portion for receiving and supporting said wall edge of said ceiling panel such that a supported said ceiling panel abuts the ceiling structure when said top end of said spacer portion is contacting said ceiling structure and said lower portion is temporarily attached to the wall; wherein said bracket is adapted for downward extraction after said ceiling panel is attached.

4. The combination of claim 3 wherein said shelf further includes:

an outer end having an outwardly downwardly slanted portion for facilitating entry of said wall edge of said ceiling panel onto said shelf.

5. The combination of claim 3 wherein said lower portion of said vertical member includes:

an aperture for receiving an extraction tool for aiding in extraction of said bracket.

6. The combination of claim 3 wherein said lower portion of said vertical member includes:

an aperture dimensioned for gripping by a human hand for aiding in extraction of said bracket.

7. The combination of claim 3 wherein said lower portion of said vertical member includes:

a bore for receiving a fastener for temporarily attaching said bracket to the wall.

8. The combination of claim 3 wherein:

said shelf includes:

an outer end having an outwardly downwardly slanted portion for facilitating entry of said wall edge of said panel onto said shelf;

said lower portion of said vertical member includes:

an aperture for receiving an extraction tool for aiding in extraction of said bracket; and a bore for receiving a fastener for attaching said bracket to the wall.

9. In combination:

a wall including:

a horizontal member including:

a lower edge;

a ceiling panel having a thickness and including:

an upper surface;

a lower surface; and a wall edge for disposition near said wall; and a wall bracket for aiding in attaching said ceiling panel to ceiling structure next to said wall; said wall bracket comprising:

a vertical member including:

a lower portion for temporary attachment to said wall including:

an aperture including:

an upward facing edge; and an upper portion including:

a spacer portion including:

a top end for contacting the ceiling structure; and a bottom end; said spacer portion having a height between said top end and said bottom end equal to the thickness of said ceiling panel; and a shelf including:

an inner end attached to said wall-abutting member at the bottom end of said spacer portion for receiving and supporting said wall edge of said ceiling panel such that a supported said ceiling panel abuts the ceiling structure when said top end of said spacer portion is contacting said ceiling structure and said lower portion is temporarily attached to said wall; wherein, when said top end of said spacer portion is contacting said ceiling structure, said aperture discloses said lower edge of said horizontal member of said wall such that an extraction tool may bear against said lower edge of said horizontal member and against said upward facing edge of said aperture for aiding in extraction of said bracket after attachment of said ceiling panel.

10. The combination of claim 9 wherein said aperture is dimensioned for gripping by a human hand for aiding in extraction of said bracket.

11. The combination of claim 9 wherein said shelf includes:

an outer end having an outwardly downwardly slanted portion for facilitating entry of said wall edge of said panel onto said shelf.

12. The combination of claim 9 wherein said lower portion of said vertical member includes:

a bore for receiving a fastener for temporarily attaching said bracket to the wall.

13. The combination of claim 9 wherein:

said aperture is dimensioned for gripping by a human hand for aiding in extraction of said bracket;

said shelf includes:

an outer end having an outwardly downwardly slanted portion for facilitating entry of said wall edge of said panel onto said shelf; and said lower portion of said vertical member includes:

a bore for receiving a fastener for temporarily attaching said bracket to the wall.

14. A method of attaching a ceiling panel to ceiling structure next to a wall; the ceiling panel having a thickness and peripheral edges; the method comprising the steps of:

procuring a wall bracket comprising a vertical, wall-abutting member for temporary attachment to the wall including: a lower portion for attachment to the wall; and an upper portion including: a spacer portion including: a top end; and a bottom end; and a height equal to the thickness of the panel; and a shelf for receiving and supporting an edge of the ceiling panel including: an inner end attached to the vertical member at the bottom end of the spacer portion;

attaching the wall bracket to the wall such that the top end of the spacer portion contacts the ceiling structure;

supporting an edge of the panel on the shelf;

fastening the panel to the ceiling.

15. The method of claim 14 wherein the wall bracket shelf further includes an outer end having an outwardly downwardly slanted portion for facilitating entry of the edge of the panel onto the shelf.

16. The method of claim 14 wherein the lower portion of the vertical member includes a bore for receiving a fastener for temporarily attaching the bracket to the wall, and the step of attaching the wall bracket to the wall includes inserting a fastener in the bore.

17. The method of claim 14 further including the step of:

downwardly extracting the bracket after the panel is fastened.

18. The method of claim 17 wherein the wall includes a horizontal member having a lower edge, and the lower portion of the vertical member includes an aperture disclosing the lower edge of the horizontal member when the bracket is temporarily attached to the wall and for receiving a prying tool for aiding in extraction of the bracket, and wherein the step of extracting the bracket is facilitated by inserting a prying tool in said aperture and prying between the bracket and the lower edge of the horizontal member.

19. The method of claim 17 wherein the wall includes a horizontal member having a lower edge and the lower portion of the vertical member includes an aperture disclosing the lower edge of the horizontal member when the bracket is temporarily attached to the wall and for receiving an extraction tool for aiding in extraction of the bracket, and wherein the step of extracting the bracket is facilitated by inserting an extraction tool in said aperture.

* * * * *